US005196657A

United States Patent [19]

Jensen

[11] Patent Number: 5,196,657

[45] Date of Patent: Mar. 23, 1993

[54] ELECTRIC SWITCH

[76] Inventor: Jorgen W. Jensen, Niels Juels Vej 18, DK-2680 Solrod Strand, Denmark, DK-2680

[21] Appl. No.: 752,476

[22] PCT Filed: Mar. 9, 1990

[86] PCT No.: PCT/DK90/00066

§ 371 Date: Sep. 6, 1991

§ 102(e) Date: Sep. 6, 1991

[87] PCT Pub. No.: WO90/10943

PCT Pub. Date: Sep. 20, 1990

[30] Foreign Application Priority Data

Mar. 14, 1989 [DK] Denmark ..... 1229/89

[51] Int. Cl.[5] ..... H01H 23/20; H01H 1/12

[52] U.S. Cl. ..... 200/6 R; 200/6 C; 200/242; 200/339; 200/557

[58] Field of Search ..... 200/6 R, 6 C, 437, 557, 200/339, 241, 242

[56] References Cited

U.S. PATENT DOCUMENTS

| | | | |
|---|---|---|---|
| 1,294,599 | 2/1919 | Bair et al. | 200/6 C |
| 3,408,463 | 10/1968 | Wanlass | 200/6 R |
| 3,475,566 | 10/1969 | Bauer | 200/52 R X |
| 3,519,775 | 7/1970 | Weremey | 200/557 X |
| 3,688,062 | 8/1972 | Yamamoto et al. | 200/437 |
| 4,575,592 | 3/1986 | Rose | 200/6 R |
| 4,733,028 | 3/1988 | Flumignan | 200/16 B |

FOREIGN PATENT DOCUMENTS

| | | |
|---|---|---|
| 134876 | 1/1977 | Denmark . |
| 2636632 | 2/1978 | Fed. Rep. of Germany . |
| 3338452 | 9/1985 | Fed. Rep. of Germany . |

*Primary Examiner*—J. R. Scott

*Attorney, Agent, or Firm*—Watson, Cole, Grindle & Watson

[57] ABSTRACT

An automatically reversing, self-cleaning electric switch preferably for use in miniature, electronic aggregates such as hearing aids comprises a box (1) manufactured from electrically insulating material with a pushing rod (2) also from electrically insulating material mounted in the upper end of the box, a U-formed spring (4) fastened in a hollow space within the pushing rod and spring legs (5,6) which depending on the position of the pushing rod may rest against one or more end terminals (7,8,9) mounted in the lower part of the box for disconnecting or connecting a current through the switch. The resilient force of the U-formed spring causes the pushing rod to revert automatically to a center or zero position when no outer force is applied to the rod and a self-cleaning effect is obtained through the spring legs (5,6) resting slidingly against the terminals (7,8,9).

1 Claim, 1 Drawing Sheet

ELECTRIC SWITCH

FIELD OF THE INVENTION

The invention relates to an electric, automatically centering and self-cleaning switch for manual operation which includes a push rod which may be shifted from neutral centre position to at least two electrically-conducting side positions that are symmetrical in relation to the centre position, and in particular the invention relates to a switch intended for use in electronic miniature devices, like hearing aids, wherein such switch may for instance be used for controlling the volume of the hearing aid.

BACKGROUND OF THE INVENTION

Electric, automatically reversing switches are known from for example German Patent Publication Nos. 2636632 and 3338452 and from U.S. Pat. No. 3,688,062 and 3,408,463, and although none of these publications seems to disclose switches intended for use in miniature electronic devices. The automatically reversing effect is imparted to the thus known automatically reversing switches either by a resilient force produced by constructing the end terminals as spring elements with which the lower end of the push rod is brought into contact when moved from its neutral position, or by use of a particular additional spring mechanism mounted in the upper part of the switch box, see for example U.S. Pat. Nos. 3,688,062 and 3,408,463. This is especially the case in the switch according to U.S. Pat. No. 3,408,463, which discloses a double-pole, double-throw electric switch for the reversing operation of a permanent magnetic motor and where the size of and clearance required by the springs or spring mechanisms in the switch box makes the switching mechanism as a whole relatively complex and space consuming, and a minimization, if any, for use in electronic miniature devices would thus encounter major problems when faced with the requirement to provide a simple and safely operating mechanism of very small outer dimensions the size of which should be comprised within about 3–4 min.

A hitherto use volume control in hearing aids is known from Danish Patent Publication No. 134876 wherein in a rotating potentiometer of very small outer dimensions is provided by a particular construction comprising a circular potentiometer resistance sheet divided into material sections having mutually different specific resistance and across which sections a sliding contact may be conductively connecting that portion of the sheet which corresponds to a desired volume control. Despite this minimized construction the rotating potentiometer in question and the accessory adjusting button are too large for incorporating into another unit, for example, the amplifier unit of a hearing aid, and consequently it should be included as a separate unit which contributes undesirably to an increase in the outer dimensions of the hearing aid aggregate.

SUMMARY OF THE INVENTION

It is the object of the invention to provide an electric switch suitable for incorporation into a miniature electronic device and which is not associated with the inconveniences described above for the hitherto known switches and which has such small outer dimensions that it may further be incorporated into a pre-existing unit, for example an amplifier, of such an electronic device and which is self-cleaning and extremely easily operated.

The object is achieved with an electric, automatically centering self-cleaning switch comprising a switch box of an electrically-insulating material, and the upper part of which forms a bearing for a push rod which is also manufactured from an electrically-insulating material, and which is provided with an internal space and which, in a central plane of the box, may be moved from a centre position symetrically to either side and when so moved tends back to its centre position by virtue of a spring mechanism within the box. The box has in its lower part securedly fixed at least three electrically-conducting terminals corresponding to a neutral centre position and activating side positions of the pushing rod. The spring mechanism is constituted by an electrically-conducting U-formed spring, the upper end of which is fixedly mounted within the space of the rod characterized in that the legs of the U-formed spring are equally long and each at their lower end is curved outwardly and project from the space down between the terminals so that the legs in the neutral or centre position of the rod are substantially parallel and both with their inner surface rest in contact with the upper part of the neutral centre terminal. In an activated side position for the switch, the leg furthest away from the side to which the push rod is moved, rests in contact with its lower outer surface against a side terminal furthest away from the side to which the push rod is moved, while the other leg remains in contact with the centre terminal for establishing an electrically-conducting connection through the spring between the relevant side terminal and the centre terminal for as long as the push rod is maintained in a side position. The space within the push rod is so designed that a clearance in the push rod is formed for the free movement of the downwardly-projecting spring legs corresponding to the side to which the rod is moved. The U-formed spring has a spring tension allowing the spring and the rod to automatically reverse to the neutral centre position of the switch when the activation of the push rod is discontinued, and the upper ends of each of the terminals are so designed that the end forms a contact surface for a sliding connection with the corresponding inside or outside of a spring leg, the contact surfaces being self-cleaning by the gliding connection of the spring leg with the corresponding contact surface when the push rod is moved to or from a side position.

BRIEF DESCRIPTION OF THE DRAWINGS

The invention will be described in further detail with reference to the accompanying drawing which depict a diagrammatical and vertical sectional view through an exemplifying embodiment of the switch and wherein.

DETAILED DESCRIPTION OF THE PREFERRED EMBODIMENT

Figure 1:
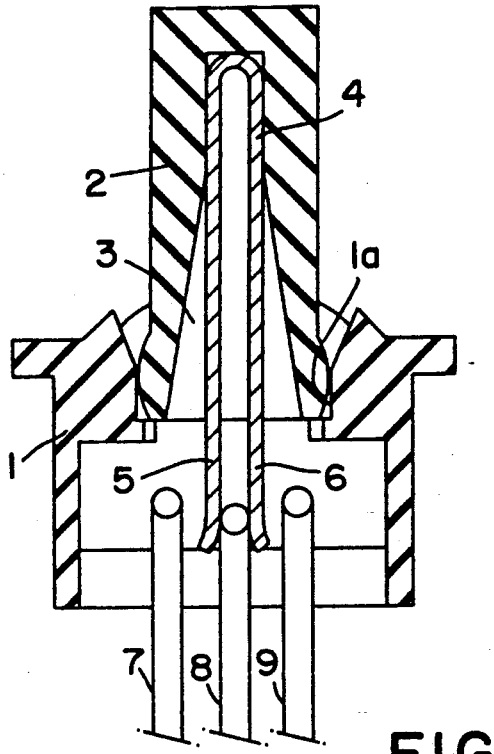
FIG. 1 shows the switch in its neutral or zero position.
Figure 2:
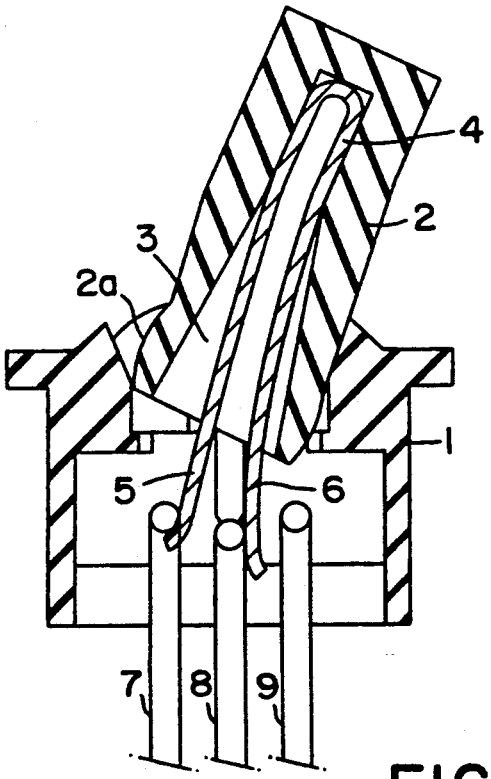
FIG. 2 shows the switch in a current-conducting position.

In the drawings 1 denotes a switch box of an electrically-insulating material. The actual switch box has a 3 mm. outer diameter and a 4 mm. height. In the upper part of the box, a bearing is provided for a bearing surface 2*a* of a push rod 2 which is movable in the central plane of the box (corresponding to the drawing plane) and which is also manufactured from an electrically-insulating material and which may be moved from a centre position symmetrically to either side. In the lower part of the box at least three electrically-conducting end terminals (7,8,9) are securedly fixed and in the example shown corresponding to the centre position of the push rod and its two side positions, one to the right and one to the left. The push rod 2 has an internal space 3 wherein a U-formed spring 4 of an electrically conducting material is mounted and from the open end of which space the substantially equally long spring legs 5,6 extend down between the upper parts of the terminals 7, 8, 9 on either side of the centre or neutral terminal 8. In the centre or the neutral position of the rod 2 both spring legs 5,6 are urged to rest with their inner surface against the upper part of the neutral terminal 8 due to the resilient force of the U-formed spring, thereby cutting off the conducting passage through the switch (FIG. 1). If the rod is moved towards one of the side positions, for example to the right as shown in FIG. 2, the one spring leg furthest away from the side to which the push rod 2 is moved, namely the leg 5, is urged with its lower outer surface to rest against the upper part of the conducting terminal 7 furthest away from the side to which the push rod 2 is moved, the internal space 3 in the push rod 2 being constructed to provide sufficient clearance for the spring leg to perform such movement. Correspondingly, a move of the rod 2 to the opposite side will urge the leg 6 to rest with its outer surface against the upper part of the conducting terminal 9. In the side position the spring 4 thus establishes an electrically-conducting connection between a side terminal and the centre terminal. When the external activation of the push rod 2 is discontinued, the resilient force of the spring 4 causes the rod and the spring proper to revert automatically to the centre position, thus disconnecting the current. The upper parts of the terminals 7,8,9 and the lower ends of the spring legs 5,6 are all conveniently constructed so as to form, in use, the largest possible mutual contact surface between the terminal in question and a spring leg, and thus making the mutual contact surfaces self-cleaning by the gliding contact of the spring leg with the upper part of a terminal when the rod 2 is moved to or from a side position.

In a horizontal plane across the switch box (for example, a plane at right angles to the plane of the drawing) the end terminals may, for space considerations, mutually form a isosceles triangle where the ends of the terminals 7,9 accordingly constitute the base line of the triangle and the end of the terminal 8 the vertex thereof. The form of the box in this horizontal plane may be circular, rectangular or polygonal in accordance with the incorporation conditions for the electronic device.

In use, the switch, which is, as said, suitable for incorporation into, for example, the amplifier of a hearing aid, causes a short circuit above the terminals for electronic actuation of the hearing aid potentiometer for the volume control for a desired amplifying or lowering effect by manual movement of the push rod to the side position in question and it is maintained in this position until the desired volume is reached. However, the use of the switch is not confined to the preferred use mentioned, the switching being applicable for any electronic miniature device wherein an electronic short circuit control is desired.

I claim:

1. An electric, automatically centering self-cleaning switch comprising a switch box of an electrically-insulating material, the upper part of the box forming a bearing for a push rod made from an electrically-insulating material, the push rod being provided with an internal space and which, in a central plane of the box, may be moved from a center position symmetrically to either side and when so moved tends to be resiliently biased back to its center position by virtue of a spring mechanism within the box, the box having in its lower part securely fixed at least three electrically-conducting terminals corresponding to a neutral center position and activating side positions of the push rod, the spring mechanism being formed as an electrically-conducting U-formed spring, the upper end of the spring being fixedly mounted within the internal space of the rod, wherein the legs of the U-formed spring are equally long, each of the legs at their lower ends being curved outwardly and projecting from the space down between the terminals so that the legs in the neutral or center position of the rod are substantially parallel and their inner surfaces rest in contact with the upper part of the neutral center terminal, in an activated side position of the switch, the leg furthest away from the side to which the push rod is moved rests in contact with its lower outer surface against a side terminal furthest away from the side to which the push rod is moved, while the other leg remains in contact with the center terminal for establishing an electrically-conducting connection through the spring between the relevant side terminal and neutral central terminal for as long as the push rod is maintained in a side position, the internal space of the push rod is designed so that a clearance tapering outwardly in the push rod is formed for the free movement of the downwardly projecting spring legs corresponding to the side to which the push rod is moved, the U-formed spring has a spring tension for allowing the spring and the push rod to automatically reverse to the neutral center position of the switch when the activation of the push rod is discontinued, and the upper ends of each of the terminals being designed so that the upper end of each terminal forms a contact surface for a sliding connection with the corresponding inside or outside of a spring leg, the contact surfaces being self-cleaning by the gliding connection of the spring leg with the corresponding contact surface when the push rod is moved to or from a side position.

* * * * *

UNITED STATES PATENT AND TRADEMARK OFFICE

CERTIFICATE OF CORRECTION

PATENT NO. : 5,196,657

DATED : March 23, 1993

INVENTOR(S) : Jørgen W. JENSEN

It is certified that error appears in the above-identified patent and that said Letters Patent is hereby corrected as shown below:

On the title page, after item [76], insert:

[73] Assignee: Microtronic A/S, Roskilde
Denmark

Signed and Sealed this

Fourteenth Day of December, 1993

Bruce Lehman

*Attest:*

BRUCE LEHMAN

*Attesting Officer*

*Commissioner of Patents and Trademarks*